US009175477B1

(12) United States Patent
Chao

(10) Patent No.: US 9,175,477 B1
(45) Date of Patent: Nov. 3, 2015

(54) GUTTER CLEANING APPARATUS

(71) Applicant: Albert Chao, Saddle River, NJ (US)

(72) Inventor: Albert Chao, Saddle River, NJ (US)

( * ) Notice: Subject to any disclaimer, the term of this patent is extended or adjusted under 35 U.S.C. 154(b) by 0 days.

(21) Appl. No.: 14/496,799

(22) Filed: Sep. 25, 2014

Related U.S. Application Data

(63) Continuation of application No. 14/477,402, filed on Sep. 4, 2014, now Pat. No. 9,074,374.

(51) Int. Cl.
*A47L 5/38* (2006.01)
*E04D 13/076* (2006.01)

(52) U.S. Cl.
CPC ..... *E04D 13/0765* (2013.01); *A47L 5/38* (2013.01)

(58) Field of Classification Search
CPC ..... A47L 5/38; E04D 13/0765
USPC ..... 15/301, 316.1, 317; 52/12, 14, 16; 405/119; 134/166 C, 168 C, 167 C, 170
IPC ..... A47L 5/38
See application file for complete search history.

(56) References Cited

U.S. PATENT DOCUMENTS

| | | | |
|---|---|---|---|
| 3,971,098 | A | 7/1976 | Davis |
| 4,349,039 | A | 9/1982 | Egger |
| 4,402,106 | A | 9/1983 | Mattson |
| 4,502,806 | A | 3/1985 | Albertson |
| 4,634,312 | A | 1/1987 | Sterzel |
| 5,056,187 | A | 10/1991 | Higgins |
| 5,195,209 | A | 3/1993 | Watkins |
| 6,519,809 | B2 | 2/2003 | Gutry |
| 6,766,560 | B2 | 7/2004 | Murphy |
| 6,926,210 | B2 | 8/2005 | Baxter |
| 7,549,191 | B2 | 6/2009 | Seasholtz et al. |
| 8,739,362 | B1 | 6/2014 | Conder |
| 2004/0143931 | A1 | 7/2004 | Dennis |

*Primary Examiner* — David Redding
(74) *Attorney, Agent, or Firm* — Notaro, Michalos & Zaccaria P.C.

(57) ABSTRACT

A gutter cleaning apparatus that cleans debris from a gutter having a concave channel for collecting water from a roof of a building, has a platform with a plurality of spaced apart apertures each including a guide flap extending at an inclined air flow directing angle from under the platform. The platform is mounted in the gutter at a selected spacing above a floor of the gutter and extends into an air flow guide engaged to an end of the platform. The guide has an outlet end with lower and upper portions for directing air flow respectively under and over the platform for lifting and remove debris from an upper surface of the platform, the platform extending at least partly into the outlet end for dividing the outlet end into the lower and upper portions, and the guide has an inlet for receiving a flow of forced air from a blower near ground level.

20 Claims, 7 Drawing Sheets

FIG. 9
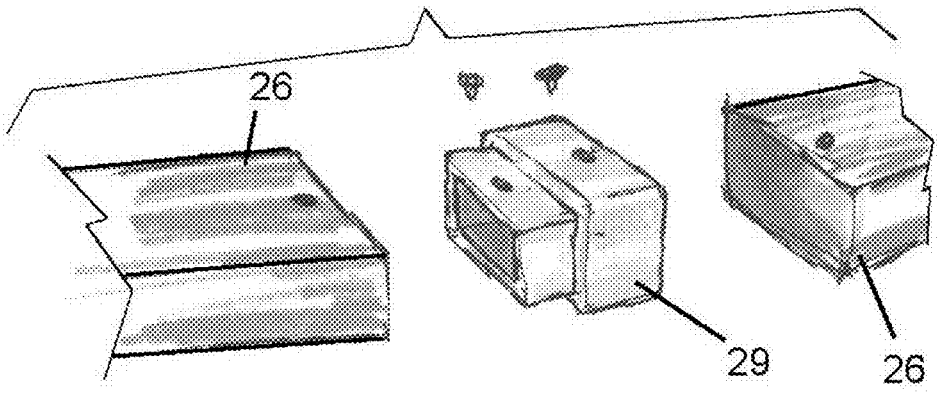
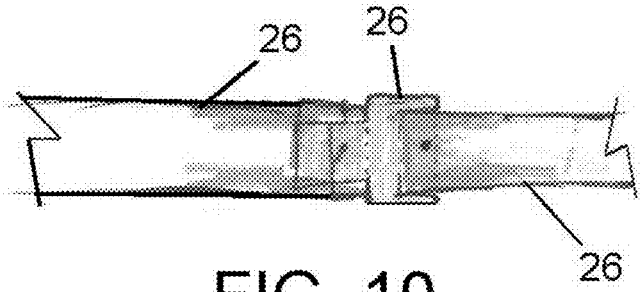
FIG. 10
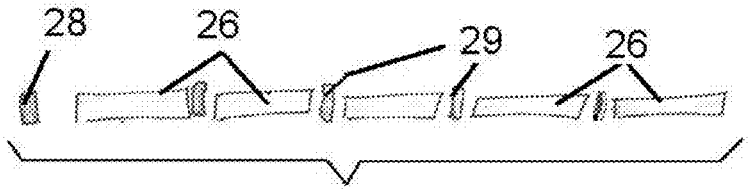
FIG. 11

GUTTER CLEANING APPARATUS

CROSS REFERENCE TO RELATED APPLICATION

This is a continuation-in-part of U.S. patent application Ser. No. 14/477,402, filed Sep. 4, 2014, which is incorporated herein by reference in its entirety.

FIELD AND BACKGROUND OF THE INVENTION

The present invention relates generally to the field of house cleaning and maintenance, and in particular to a new and useful gutter cleaning apparatus that can effectively remove leaves and other debris from house gutters.

It is known to use blowers to remove leaves from lawns. Since this is done at ground level, there is no issue of danger or access to the area to be cleaned. While a blower may be effective to remove leaves and debris from gutters, a ladder and long power cord would be needed for electric blowers, and using heavier gas powered blowers would be awkward and potentially dangerous to use high off the ground.

In order to take advantage of leaf blowers to clean gutters, several approaches are known for using long air containing conduits from the blower at ground level up to a guide or other air directing mechanism at the gutter level. See for example, the following: U.S. Pat. No. 3,971,098 for Gutter Cleaning Nozzle; U.S. Pat. No. 4,349,039 for Home Roof Gutter Sweep; U.S. Pat. No. 4,402,106 for Blower Attachment for Cleaning Rain Gutters; U.S. Pat. No. 4,502,806 for Gutter Cleaning Device; U.S. Pat. No. 4,634,312 for Self Cleaning Drain Gutter or Pipe; U.S. Pat. No. 5,056,187 for Eave Trough Cleaning Apparatus; U.S. Pat. No. 5,195,209 for Gutter Cleaning System; U.S. Pat. No. 6,519,809 for Gutter Cleaner; U.S. Pat. No. 6,766,560 for Gutter Leaf-Blower; U.S. Pat. No. 6,926,210 for System for Maintaining Gutter Debris Free; U.S. Pat. No. 7,549,191 for Gutter Cleaning Blower Vacuum Attachment Apparatus; U.S. Pat. No. 8,739,362 for Gutter Cleaning Attachment for a Leaf Blower; U.S. published patent application US 2004/0143931 for Gutter Cleaning System.

It is also known to use water jets to clean gutters. Since gutters are usually one, two or sometimes three stories of the ground, long spray wards are needed for gutters that are closer to the ground, and ladders must be used for higher gutters. Also, if the spray of water is not immediately effective to the remove the leaves and other debris from the gutters, the leaves and debris get wet, heavy and sticky and therefor become more difficult to remove.

A need remains for an effective new way to clean household gutters using a blower rather than a jet of water.

SUMMARY OF THE INVENTION

It is an object of the present invention to provide a gutter cleaning apparatus that uses a blower, preferably near ground level to clean leaves and debris, collectively here called debris, from the gutters of a house or other building, collectively here called a building.

Accordingly, another object of the invention is to provide a gutter cleaning apparatus for cleaning debris from a gutter having a concave, rectangular or curved, channel for collecting and guiding water from a roof of a building, the apparatus comprising, a platform for mounting in a gutter at a selected spacing above a floor of the gutter, the platform having a plurality of spaced apart apertures each including a guide flap extending at an inclined air flow directing angle from under the platform, and an air flow guide engaged to an end of the platform, the guide having an outlet end with lower and upper portions for directing air flow respectively under and over the platform for lifting and removing debris from an upper surface of the platform, the platform extending at least partly into the outlet end for dividing the outlet end into the lower and upper portions, and the guide having an inlet for receiving a forced air flow.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 9 is an exploded view of a joiner member of an embodiment of the invention for connecting two air flow channels to each other;

FIG. 10 shows the joiner member of FIG. 9, joining two channels to each other; and FIG. 11 is an exploded view showing multiple channels to be connected to each other for servicing a length of gutter according to the invention.

DESCRIPTION OF THE PREFERRED EMBODIMENTS

Figure 1:
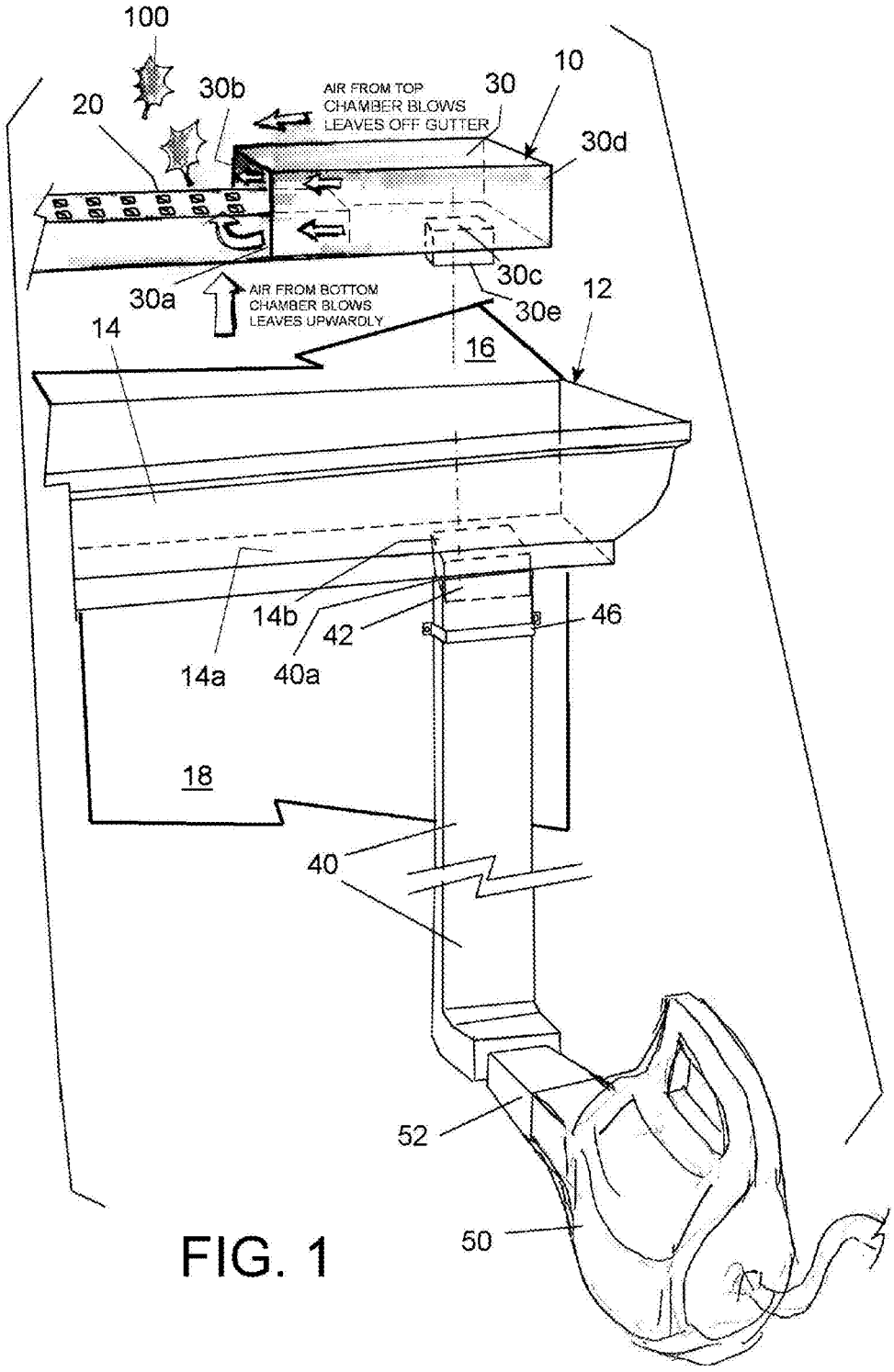
FIG. 1 is an exploded view of a gutter cleaning apparatus according to the present invention.

Referring now to the drawings, in which like reference numerals are used to refer to the same or similar elements, FIG. 1 shows a gutter cleaning apparatus 10 for cleaning debris from a building gutter 12 having a concave channel 14 for collecting and guiding water from a roof 16 of a building 18. The apparatus comprises a water and air permeable platform 20 for mounting in the gutter 12 at a selected spacing above a floor 14*a* of the gutter channel 14 and an air flow guide 30 engaged to an end of the platform 20. The selected spacing is about 1 inch but may be preferable about ½ to 2 inches. Platform 20 preferably has a width to cover the entire floor 14*a* of the gutter which is about 3 to 4 inches in most cases, although customized gutters of other dimensions can also cleaned using the present invention.

The guide 30 has an outlet end with a lower portion 30*a* and an upper portion 30*b* for directing air flow respectively under and over the platform 20 for both lifting debris such a leaves 100, up off the platform, and for removing debris from the platform and gutter, as illustrated by the arrows in FIG. 1.

The platform 20 extends at least partly into the outlet end of guide 30 for dividing the outlet end into the lower and upper portions 30*a* and 30*b*. Guide 30 also has an inlet at 30*c* for receiving a forced air flow from a blower 50 near ground level. Opposite from outlet 30*a* and 30*b*, guide 30 has a closed wall 30*d* and its top, sides and bottom are also closed and solid, except for inlet 30*c* at the bottom. Platform 20 is preferably the perforated top panel of an elongated rectangular or other shaped tube section or channel that is connected along the floor 14*a* of the gutter 12 as will be explained more detail later in this disclosure. As many tube sections as needed are lain end-to-end in the gutter 12. To help maintain some air confinement between adjacent sections, one end of each section may be made smaller than an opposite end to telescope into its neighbor. Otherwise care should be taken to lay one section immediate abutting its neighbor. Some air leakage between sections is acceptable, however, since such leakage will help lift debris up off the junction between sections in any case, in accordance with the desired cleaning effect of the invention.

The tube sections for platforms 20 preferably made of sheet metal, for example aluminum, of a gauge and type that is conventional for building gutters. Guide 30 may be made of plastic.

As shown in FIG. 1, the gutter cleaning apparatus of the invention also includes an air flow conduit or pipe 40 having an air outlet 40*a* at the top that, in a preferred embodiment of the invention, also forms the water inlet from gutter 12, the conduit 40 therefore also forming the down spout for gutter 12. Air outlet/water inlet 40*a* is connected to the air flow guide inlet 30*c*. The conduit or down spout 40 has a lower opening for discharging water during rain in the usual manner of a down spout, but this lower opening also serves as a blower air inlet far below the floor 14*a* of the gutter 12, and at a convenient level near the ground for receiving a suitably shaped and sized outlet tube 52 of the blower 50 for cleaning the gutter during dry climate by receiving forced air flow from the blower.

Conduit 40 can act as both the down spout and as the blower air conduit because of the large apertures 20*b* that pass sufficient amounts of water into channel 26 and therefore to the guide outlet 30*c*, that also service as the down spout inlet, during rain. The apertures 20*b* as shown to be square or rectangular but may be any shape as long as each has it guide flap to redirect air upwardly from below platform 20. The percentage of total area of all apertures 20*b* to the total platform 20 area should be at least about 10%, preferably at least about 30%, or more preferably at least about 50%.

The air outlet 40*a* of conduit or down spout 40, that also serves as the water outlet, is fixed to the air flow guide inlet 30*c* of guide 30 with the aid of a cap fitting 42 that extends downwardly from the inlet 30*c* and into the upper opening of conduit 40. A male fitting 30*e* extends downwardly form the bottom wall of guide 30 and closely fits into fitting 42.

Conduit or down spout 40 is secured in place with respect to building 18, for example, by one or more U brackets 46 of the type used for securing gutter down spouts, for example. Cap 42 and conduit 40 are made of PVC or other known polymer, or of sheet metal or other self supporting material. Alternatively, conduit 40 may be flexible, for example in the form of an expandable tubing of the type used for dryer exhausts or the like. The purpose of conduit 40 is to make a forced air flow from a blower near ground level, available at the inlet 30*c* of guide 30.

According to the gutter cleaning apparatus of the invention with an air outlet connected through a hole in the floor of the gutter and an air inlet spaced below the floor of the gutter and at a level for access by a user standing at ground level, blower 50 is used by engaging the conduit to supply forcing air into the guide 30 and thus clean debris from the gutter 12 using only air, without the mess of water and without wetting the debris and thereby making it heavy, sticky and harder to remove.

By providing a space below the water and air permeable platform 20, and by blowing air both under, via outlet portion 30*a*, and over, via outlet portion 30*b*, the platform, leaves 100 and other debris are simultaneously lifter and lofted from the top of the platform and blown laterally across the platform away from the guide 30, and thus randomly off the gutter 12 along a significant length of gutter.

Figure 2:
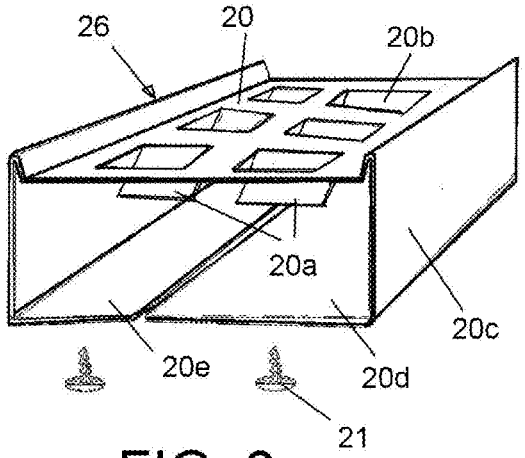
FIG. 2 is an enlarged, partial and perspective view of a box beam channel forming part of an embodiment of the invention.
Figure 3:
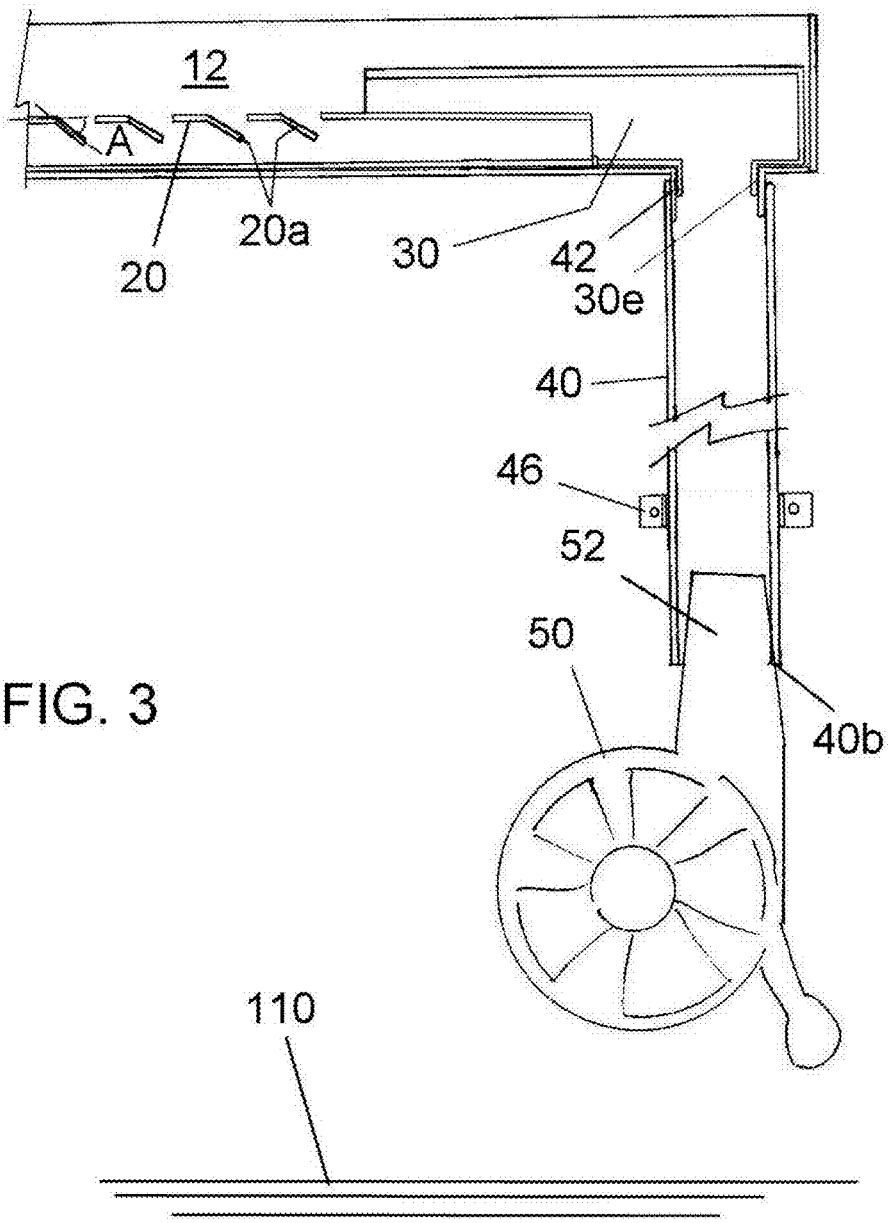
FIG. 3 is a schematic side sectional view of an embodiment of the invention.

This lifting and clearing effect has been found to be greatly increases by providing platform 20 with a plurality of spaced apart apertures 20*b* each including a guide flap 20*a* extending at an inclined air flow directing angle from under the platform as best shown in FIGS. 2 and 3. This air flow directing angle, shown at A in FIG. 3, is about 10 to 60 degrees and each guide flap faces an upstream direction with respect to the lower portion 30*a* of the guide outlet for receiving air flow and for effectively diverting it upwardly through a respective aperture of the platform. Angle A may preferably be about 20 to 45 degrees and most preferably about 30 degrees.

It is contemplated that a guide 30 will be provided at each end of each length of gutter, with convenient lengths of tube section with platforms 20, strung along the space between the guides and in the channel 14 of the gutter 12.

As best shown in FIG. 2, the platform 20 may preferably be the top wall of a box beam channel 26 that has opposite side walls 20*c* and bottom flanges 20*d* and 20*e* that are connected to the floor 14*a* of the gutter 12 by self-tapping screws 21 that self drill through the gutter floor and into the flanges 20*d*, 20*e*. To help maintain a close engagement between the bottom flanges of the channel 26 and the gutter floor, the bottom wall of guide 30 may be cut out under the section of channel 26 that extends into the guide 3 as shown in FIG. 30, and the section of platform 20 extending into guide 30 is left without apertures 20*b*. This saves air flow from being channeled upwardly to soon and therefore wasted (see the curves arrow in FIG. 1), before it is in the area of platform 20 that may have leaves 100 or other debris on it to be blown away.

Figure 4:
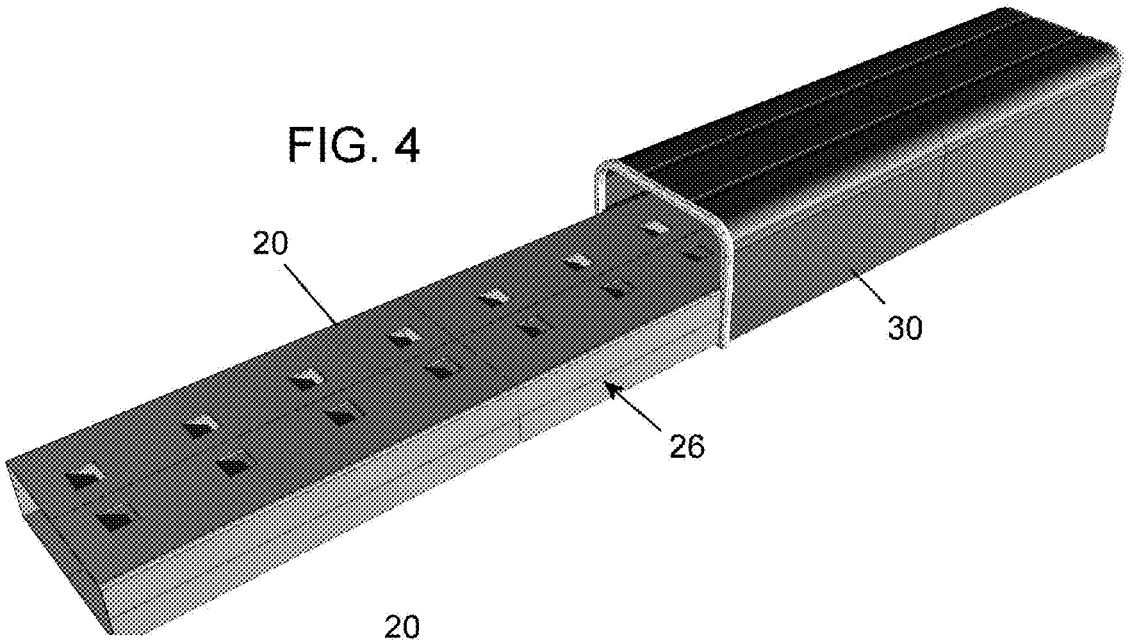
FIG. 4 is a partial perspective view of a guide and platform section of the invention.
Figure 5:
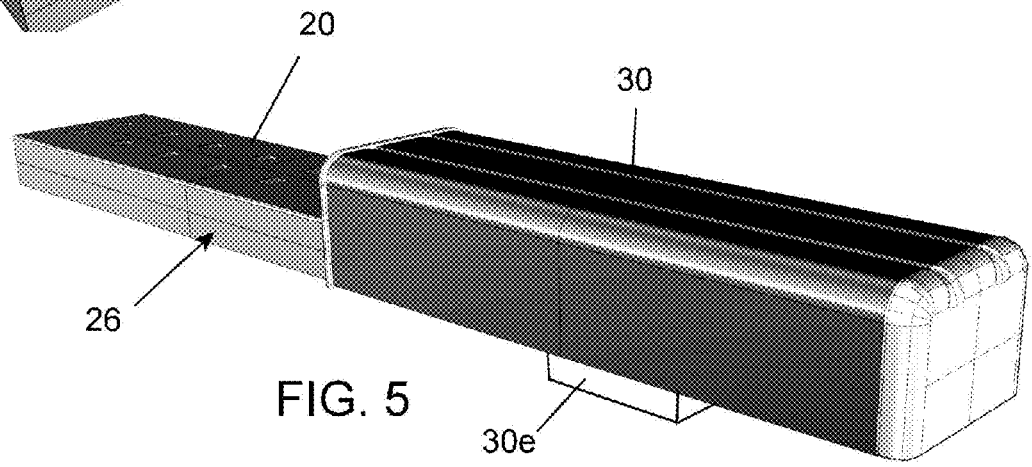
FIG. 5 is a partial perspective view of the structures of FIG. 4, taken from a different angel.

FIGS. 4 and 5 illustrate two sections of box beam channel 26 and the guide 30 with its male fitting 30*e*.

Figure 6:
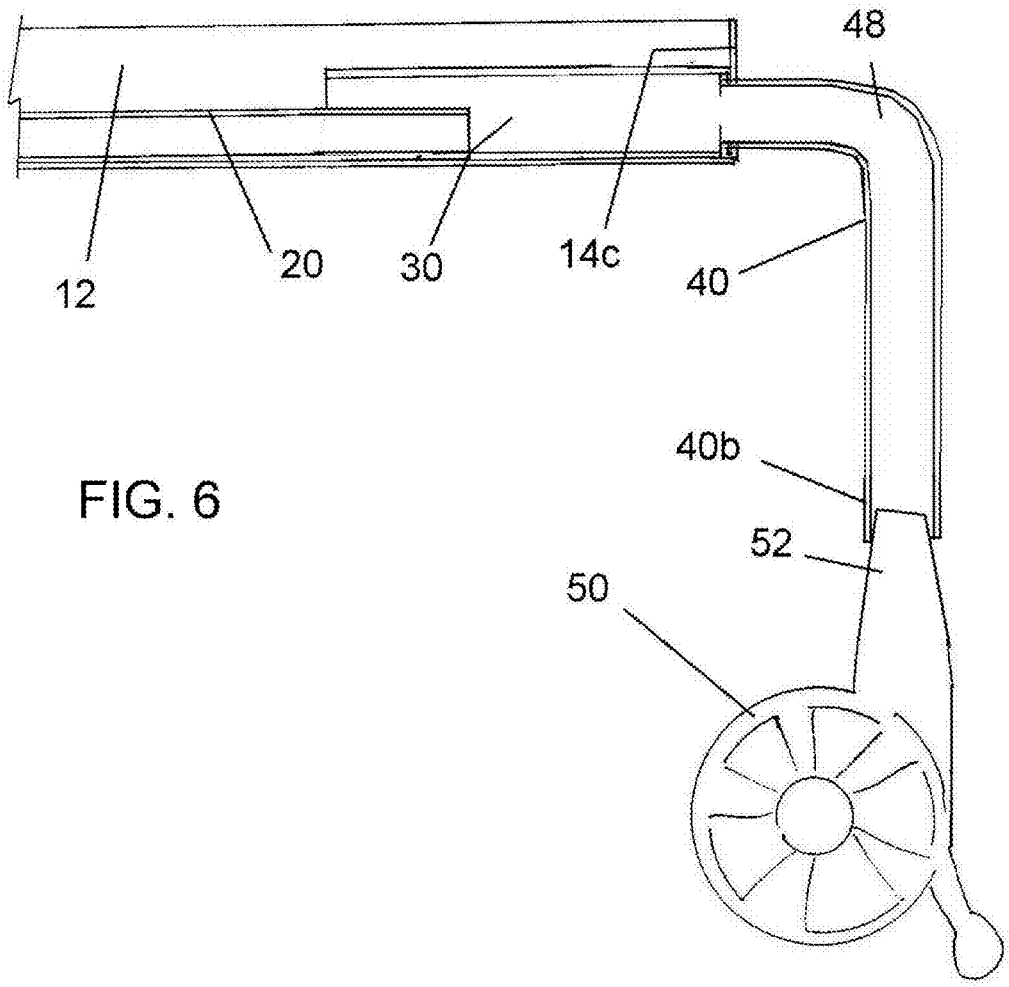
FIG. 6 is a view similar to FIG. 3 of another embodiment of the invention.

FIG. 6 illustrates an embodiment of the invention where access to the inlet of the guide 30 is via a hole in the end cap 14*c* of the gutter 12. A conduit 40 with an elbow 48 is used in this embodiment to reach the blower 50 that is near ground level. The blower outlet tube 52 is engaged with the conduit inlet 40*b* that is near ground level.

Figure 7:
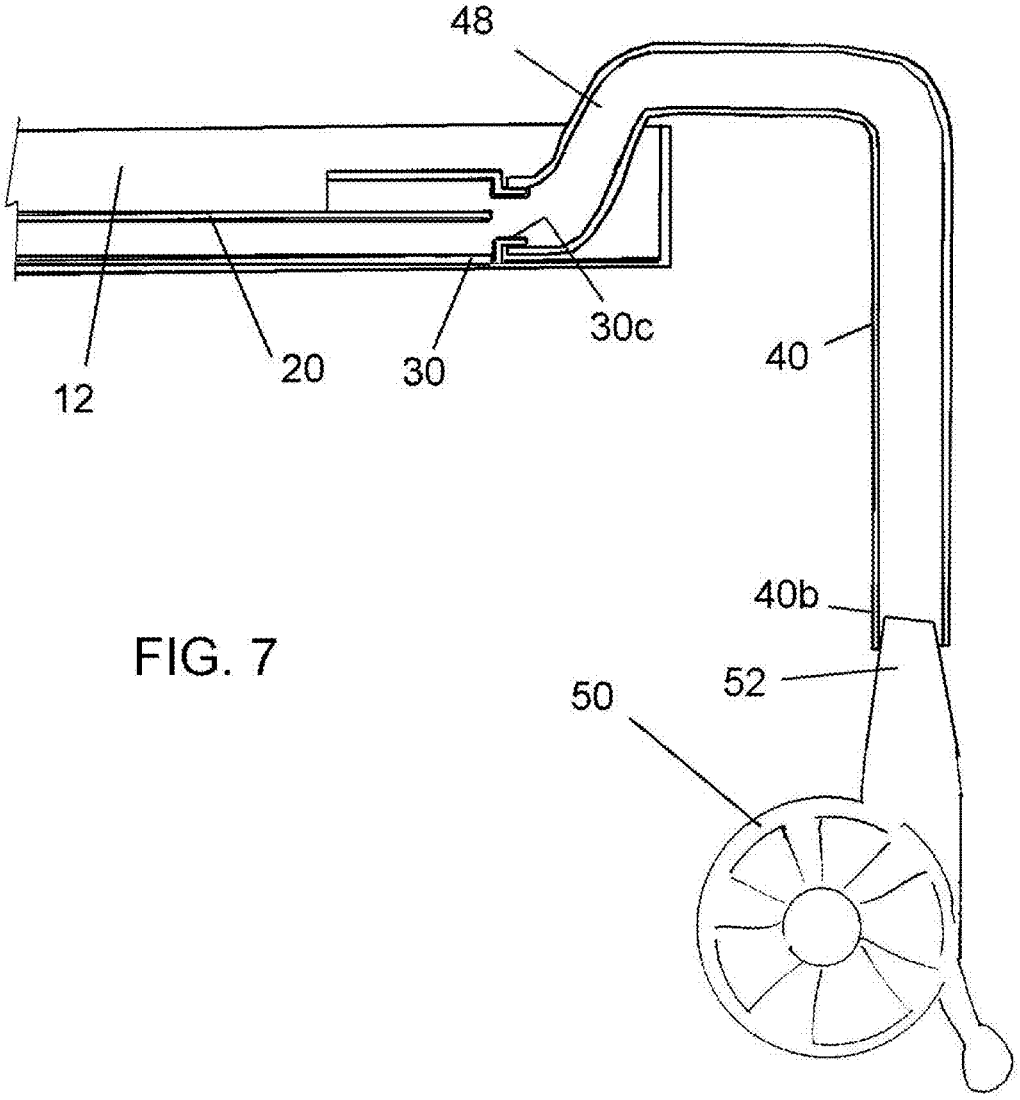
FIG. 7 is a view similar to FIG. 3 of a still further embodiment of the invention.

FIG. 7 illustrates an embodiment of the gutter cleaning apparatus of the invention that includes an air flow conduit 40 having an outlet connected at an elbow or curved section 48, over a rim of the gutter, and to a air flow guide inlet 30*c* that is in a rear wall of the 30. The conduit 40 has an inlet 40*b* adapted to be spaced below the floor at a level for access by a user standing at ground level, the apparatus including a blower 50 with an outlet tube 52 engaged with the conduit inlet for supplying forcing air into the conduit inlet to supply air to the guide inlet and thereafter under and over the platform 20.

Figure 8:
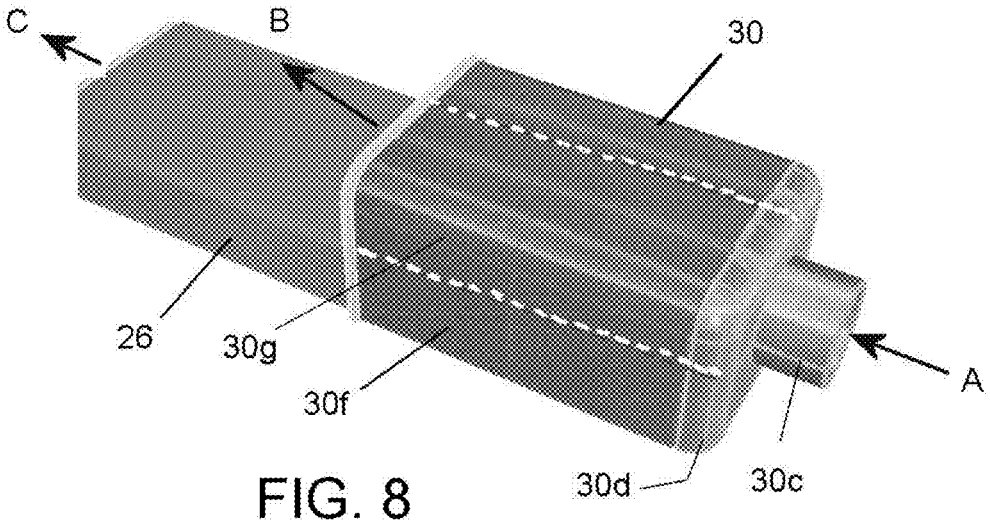
FIG. 8 is a perspective view of part of the embodiment of FIG. 7 to better show the air flow pattern of the invention.

FIG. 8 shows how the un-perforated portion of platform 20 on an section of channel 26 extending into the guide 30, divides the volume of the guide into a lower portion 30*f* and an upper 30*g* portion. This section of channel 26 is, for example, is about 6 inches long, 3 inches wide and 1 inch tall and is made of aluminum.

The channel 26 in FIG. 9 projects by about 2 inches from the end of guide 30 so that it can be connected, e.g. by one or more screws, to a large dimensioned end of a joiner member 29 of plastic. As shown in FIGS. 10 and 11, the joiner member 29 has an opposite small dimensioned end that engages inside a first channel section 26 with perforated platform 20, and is connected by one or more screws to this next channel section. As shown in FIG. 11, any number of sections 26 are thereby connected to each other by laying in a gutter, with the open end of the last channel section 26 being closed by end cap 28. Adhesive or other means may be used to fasten the joiner members 29 and cap 28 to the channels 26.

While specific embodiments of the invention have been shown and described in detail to illustrate the application of the principles of the invention, it will be understood that the invention may be embodied otherwise without departing from such principles.

What is claimed is:

1. A gutter cleaning apparatus for cleaning debris from a gutter having a concave channel for collecting and guiding water from a roof of a building, the apparatus comprising:

a platform for mounting in a gutter at a selected spacing above a floor of the gutter, the platform having a plurality of spaced apart apertures each including a guide flap extending at an inclined air flow directing angle from under the platform; and an air flow guide engaged to an end of the platform, the guide having an outlet end with lower and upper portions for directing air flow respectively under and over the platform for lifting and removing debris from an upper surface of the platform, the platform extending at least partly into the outlet end for dividing the outlet end into the lower and upper portions, and the guide having an inlet for receiving a forced air flow.

2. The gutter cleaning apparatus of claim 1, including an air flow conduit having an outlet connected to the air flow guide inlet, and an inlet adapted to be spaced below the floor of the gutter and adapted to receive forced air flow from a blower.

3. The gutter cleaning apparatus of claim 1, including an air flow conduit having an outlet connected to the air flow guide inlet, and an inlet adapted to be spaced below the floor at a level for access by a user standing at ground level, the air flow guide inlet being in a floor of a gutter connected to the apparatus and the conduit comprising a down spout for channeling water away from a gutter connected to the apparatus.

4. The gutter cleaning apparatus of claim 1, including an air flow conduit having an outlet connected through a hole in the floor of the gutter and to the air flow guide inlet, and an inlet adapted to be spaced below the floor at a level for access by a user standing at ground level, the apparatus including a blower engaged with the conduit for supplying forcing air into the conduit inlet to supply air to the guide inlet.

5. The gutter cleaning apparatus of claim 1, including an air flow conduit having an outlet connected over a rim of the gutter and to the air flow guide inlet, and an inlet adapted to be spaced below the floor at a level for access by a user standing at ground level.

6. The gutter cleaning apparatus of claim 1, wherein the air flow directing angle is about 10 to 60 degrees and wherein each guide flap faces an upstream direction with respect to the lower portion of the guide outlet for receiving air flow and diverting it upwardly through a respective aperture of the platform.

7. The gutter cleaning apparatus of claim 1, wherein the air flow directing angle is about 20 to 45 degrees and wherein each guide flap faces an upstream direction with respect to the lower portion of the guide outlet for receiving air flow and diverting it upwardly through a respective aperture of the platform.

8. The gutter cleaning apparatus of claim 1, wherein the platform includes at least one side sheet portion for extending toward the floor of a gutter for setting the selected spacing, and bottom sheet portion along a lower edge of the side sheet portion for connecting to the floor of a gutter.

9. The gutter cleaning apparatus of claim 1, wherein the platform includes a pair of opposite side sheet portions for extending toward the floor of a gutter for setting the selected spacing, and a pair of bottom sheet portions along respective lower edges of the side sheet portions for connecting to the floor of a gutter.

10. The gutter cleaning apparatus of claim 1, wherein the platform comprises a box channel, the guide having a rear wall with an inlet collar and a frame for receiving an end of the box channel in the guide.

11. A gutter cleaning apparatus for cleaning debris from a gutter having a concave channel for collecting and guiding water from a roof of a building, the apparatus comprising:

a box beam channel for mounting in a gutter, the channel having an upper platform at a selected spacing above a floor of the gutter, the platform having a plurality of spaced apart apertures each including a guide flap extending at an inclined air flow directing angle from under the platform; and an air flow guide engaged to an end of the channel, the guide having an outlet end with lower and upper portions for directing air flow respectively under and over the platform for lifting and removing debris from an upper surface of the platform, the platform having an aperture-free section extending at least partly into the outlet end of the guide for dividing the outlet end into the lower and upper portions, and the guide having an inlet for receiving a forced air flow.

12. The gutter cleaning apparatus of claim 11, including an air flow conduit having an outlet connected to the air flow guide inlet, and an inlet adapted to be spaced below the floor of the gutter and adapted to receive forced air flow from a blower.

13. The gutter cleaning apparatus of claim 11, including an air flow conduit having an outlet connected to the air flow guide inlet, and an inlet adapted to be spaced below the floor at a level for access by a user standing at ground level, the air flow guide inlet being in a floor of a gutter connected to the apparatus and the conduit comprising a down spout for channeling water away from a gutter connected to the apparatus.

14. The gutter cleaning apparatus of claim 11, including an air flow conduit having an outlet connected through a hole in the floor of the gutter and to the air flow guide inlet, and an inlet adapted to be spaced below the floor at a level for access by a user standing at ground level, the apparatus including a blower engaged with the conduit for supplying forcing air into the conduit inlet to supply air to the guide inlet.

15. The gutter cleaning apparatus of claim 11, including an air flow conduit having an outlet connected over a rim of the gutter and to the air flow guide inlet, and an inlet adapted to be spaced below the floor at a level for access by a user standing at ground level.

16. The gutter cleaning apparatus of claim 11, wherein the air flow directing angle is about 10 to 60 degrees and wherein each guide flap faces an upstream direction with respect to the lower portion of the guide outlet for receiving air flow and diverting it upwardly through a respective aperture of the platform.

17. The gutter cleaning apparatus of claim 11, wherein the air flow directing angle is about 20 to 45 degrees and wherein each guide flap faces an upstream direction with respect to the lower portion of the guide outlet for receiving air flow and diverting it upwardly through a respective aperture of the platform.

18. The gutter cleaning apparatus of claim 11, wherein the platform includes at least one side sheet portion for extending toward the floor of a gutter for setting the selected spacing, and bottom sheet portion along a lower edge of the side sheet portion for connecting to the floor of a gutter.

19. The gutter cleaning apparatus of claim 11, wherein the platform includes a pair of opposite side sheet portions for extending toward the floor of a gutter for setting the selected spacing, and a pair of bottom sheet portions along respective lower edges of the side sheet portions for connecting to the floor of a gutter.

20. The gutter cleaning apparatus of claim 11, wherein the platform comprises a box channel, the guide having a rear wall with an inlet collar and a frame for receiving an end of the box channel in the guide.

* * * * *